United States Patent [19]

Schroff et al.

[11] Patent Number: 4,867,386

[45] Date of Patent: Sep. 19, 1989

[54] THREAD GUIDING APPARATUS

[75] Inventors: Bernard Schroff, Oetwil; Wolfgang Stadlin, Au; Hans Wyssmann, Zürich, all of Switzerland

[73] Assignee: Maschinenfabrik Schärer AG, Erlenbach, Switzerland

[21] Appl. No.: 256,957

[22] Filed: Oct. 13, 1988

[30] Foreign Application Priority Data

Oct. 17, 1987 [CH] Switzerland ..... 04097/87

[51] Int. Cl.[4] ..... B65H 54/32

[52] U.S. Cl. ..... 242/43 A; 242/43.1

[58] Field of Search ..... 242/43 A, 43.1, 18.1, 242/43 R

[56] References Cited

U.S. PATENT DOCUMENTS 3,659,796 5/1972 Bucher et al. ..... 242/18.1

3,823,886 7/1974 Siegenthaler ..... 242/43.1

*Primary Examiner*—Stanley N. Gilreath

*Attorney, Agent, or Firm*—Werner W. Kleeman

[57] ABSTRACT

Each of the thread guide wings comprises a pair of leg members. Teeth located at the leg members of each pair mesh with an associated gear secured to an associated concentrically arranged adjustment shaft. By accomplishing relative motion between the adjustment shafts, which carry the thread guide wings, and the associated gear it is possible to adjust the diameter or lengthwise extent of the thread guide wings by displacing the leg members. A corresponding reduction or enlargement of the diameter or lengthwise extent of the thread guide wings causes a displacement of the thread transfer points and thus the stroke along which the thread is shifted. Altering the thread stroke can be accomplished by a stepping motor or as a function of the diameter of the bobbin upon which the thread is wound.

16 Claims, 3 Drawing Sheets

THREAD GUIDING APPARATUS

BACKGROUND OF THE INVENTION

The present invention relates to a new and improved thread guiding or guide apparatus for winding different types of materials, in particular filamentary materials such as threads, yarns or the like. In the description to follow, such materials will be generally broadly referred to herein as simply "threads".

In its more particular aspects, the present invention relates to a thread guiding or guide apparatus for winding-up threads into cross-wound bobbins and which is of the type comprising two counter- or oppositely rotating thread guide wings or vanes rotating about eccentrically arranged axes of rotation. The length of the thread guide wings or vanes can be altered during the rotational movement thereof.

It is well known in the textile art that thread guide apparatuses at winding machines serve the purpose of laying in a cross-wise configuration or array the threads or the like.

In German Patent Publication No. 2,108,866, and the cognate U.S. Pat. No. 3,823,886, granted July 16, 1974, there is disclosed a thread guide apparatus wherein the laying of the thread to form a cross-wound bobbin is accomplished with counter-rotating superimposed thread guide wings or vanes which intersect at the thread deflection points or locations. The thread guide wings or vanes each comprise two leg members or legs, the length of which can be altered in order to be able to change the length of the thread winding stroke for altering so-called pineapple or bi-conical bobbins. The adjustment of the legs or leg members of the thread guide wings or vanes is accomplished by circular-shaped cams in which engage appropriate cam blocks at the leg members of the thread guide wings or vanes. In this way, there can be altered the length of the leg members of the thread guide wings or vanes depending upon the position of the cams with respect to the center of rotation of the thread guide wings or vanes.

This prior art construction of thread guide apparatus is associated with the shortcoming that with the conventionally encountered guite high number of strokes which prevail during the thread laying operation there arises an appreciable wear both at the cams and also at the cam blocks.

SUMMARY OF THE INVENTION

Therefore with the foregoing in mind it is a primary object of the present invention to provide a new and improved construction of a thread guiding or guide apparatus which does not suffer from the aforementioned drawbacks and shortcomings of the prior art construction.

Another and more specific object of the present invention is directed to the provision of a new and improved construction of a thread guiding apparatus by means of which the length adjustment of the thread guide wings or vanes can be accomplished simply and altered during rotation of the thread guide wings or vanes, and furthermore, wherein there does not occur any wear during operation with constant length of the thread guide wings or vanes in the adjustment device.

Now in order to implement these and still further objects of the invention, which will become more apparent as the description proceeds, the thread guiding or guide apparatus of the present development, among other things, is manifested by the features that each of both of the thread guide wings or vanes comprises two legs or leg members. The two leg members of each of the thread guide wings or vanes are arranged to be point-symmetrical with respect to the associated axis of rotation thereof and these leg members of each thread guide wing or vane are guided to be lengthwise deplaceable and internally possess teeth or teeth means. The teeth or teeth means of the leg members of each thread guide wing engage with an entrainment member or entrainment means seated upon an associated drive sleeve or sleeve member. This associated drive sleeve or sleeve member carries the related leg members of the corresponding thread guide wing and is arranged concentrically to the associated axis of rotation of the thread guide wing.

An essential advantage of the thread guide apparatus of the present development resides in the fact that the alteration of the length of the thread guide wings or vanes can be accomplished at any time, independent of a predetermined cam shape and in direct or indirect dependency upon the diameter of the bobbin or another parameter.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereo, only enough of the construction of the winding machine and the associated thread guiding apparatus has been illustrated therein as is needed to enable one skilled in the art to readily understand the underlying princples and concepts of this invention.

Figure 1:
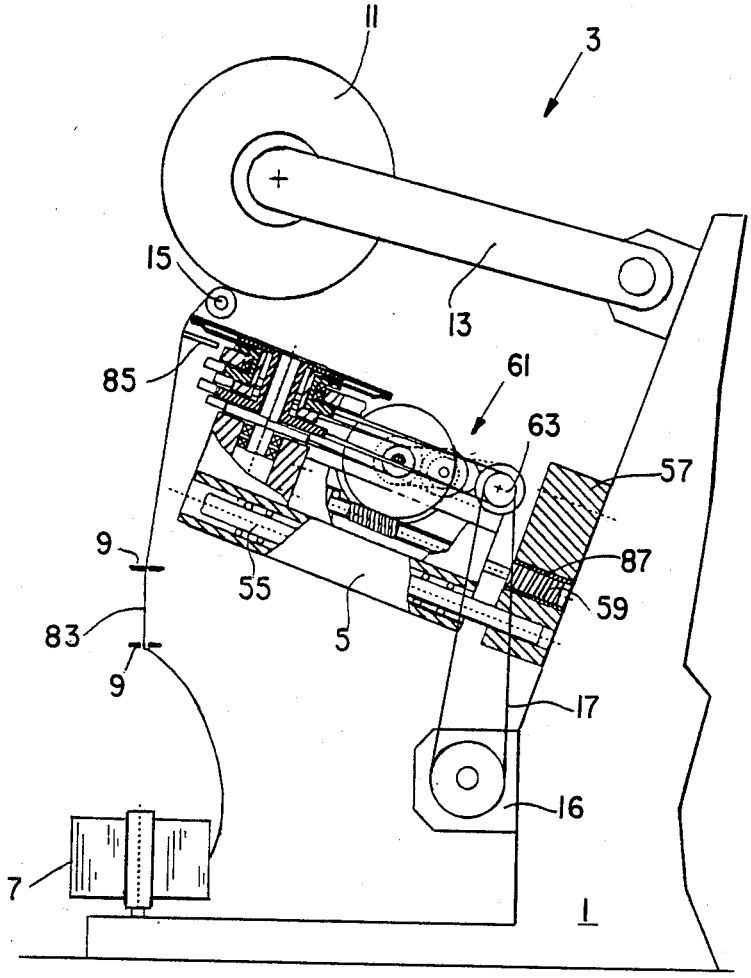
FIG. 1 is a schematic cross-sectional view of a winding location of a winding machine constructed according to the present invention.

Turning attention now specifically to FIG. 1 of the drawings, for clarity in illustration it will be understood that as to the depicted machine frame 1 of the winding or wind-up machine 3 only those components thereof have been illustrated at which there is secured the inventive thread guiding or guide apparatus 5. It will be observed that at the base of the machine frame 1 there is mounted a thread supply spool 7 which delivers a thread or the like through the thread guides or guide elements 9. Above the thread guiding apparatus 5 there is located a thread wind-up or winding or receiving bobbin 11 which is connected by means of a pivotable arm or arm member 13 with the machine frame 1. This thread wind-up or winding bobbin 11 bears upon a support roll or roller 15 which likewise is mounted at the machine frame 1.

A suitable drive or drive means 16 is secured beneath the thread guiding apparatus 5 at the machine frame 1. The drive or drive means 16 can be constituted by an individual drive for each winding location or by a drive shaft which extends throughout the entire length of the winding machine 3. An endless belt or belt member 17 extends from the drive 16 to a drive or driving shaft or shaft member 63 for the thread guiding apparatus 5.

The thread guiding apparatus 5 will now be described in greater detail based upon the enlarged illustrations of FIGS. 2 and 3.

Two double-sided thread guide wings or vanes 19 and 21 are rotatably mounted for rotation about the eccentrically arranged axes of rotation A and B, respectively. Both of the legs or leg members 23 of the thread guide wing 19 are guided so as to be lengthwise displaceable in slots or guide grooves 25 extending in point-symmetrical relationship with respect to the axis of rotation A. These slots or guide grooves 25 are arranged at the end face or side of an associated drive sleeve or sleeve member 27. Both of the legs or leg members 29 of the other thread guide wing or vane 21 are likewise guided in slots or guide grooves 31, only partly visible in the showing of FIG. 3, and which are provided at the end face or side of the associated drive sleeve or sleeve member 33 so as to be likwise lengthwise displaceable. Here also the guide slots 31 are arranged in point-symmetrical relationship with respect to the associated rotational axis B. It is here remarked that in case of bent or flexed leg members 23 and 29, such flexed leg members are then guided in correspondingly configured guides at the drive sleeves 27 and 33, respectively.

Continuing, it will be observed that the drive sleeve or sleeve member 33 has piercingly extending therethrough the drive sleeve or sleeve member 27. Moreover, the flange-like widened end face of the drive sleeve 33 is located beneath the likewise flange-shaped widened end face or surface of the drive sleeve 27. At the center of the drive sleeve 27 there is inserted an adjustment shaft or shaft member 35 having a gear 37 which is attached at an end face thereof. This gear 37 meshes with teeth 39 provided at the leg members 23 of the thread guide wing 19. In an analogous fashion, there is located within the drive sleeve 33 a substantially tubular-shaped adjustment shaft or shaft member 41 having a gear 43 which is mounted at an end face or side thereof. This gear 43 meshed with teeth 45 provided at the leg members 29 of the thread guide wing or vane 21.

Figure 4:
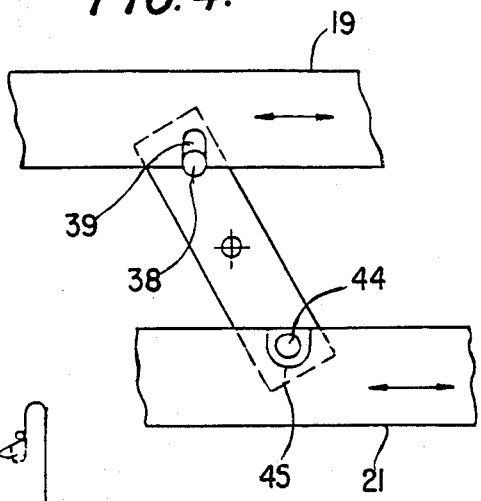
FIG. 4 is a top plan view of a modified construction of an entrainment device for the thread guiding apparatus.

It is here remarked that it would be possible, as shown in FIG. 4, to employ instead of the gears 37 and 43 also two bolt members 38 and 44 which are arranged at equal-armed levers in spaced relationship from the axis of rotation. These bolts or bolt members 38 and 44 engage with cutouts serving as teeth 39 and 45, respectively, provided at the legs or leg members 23 and 29.

Figure 2:
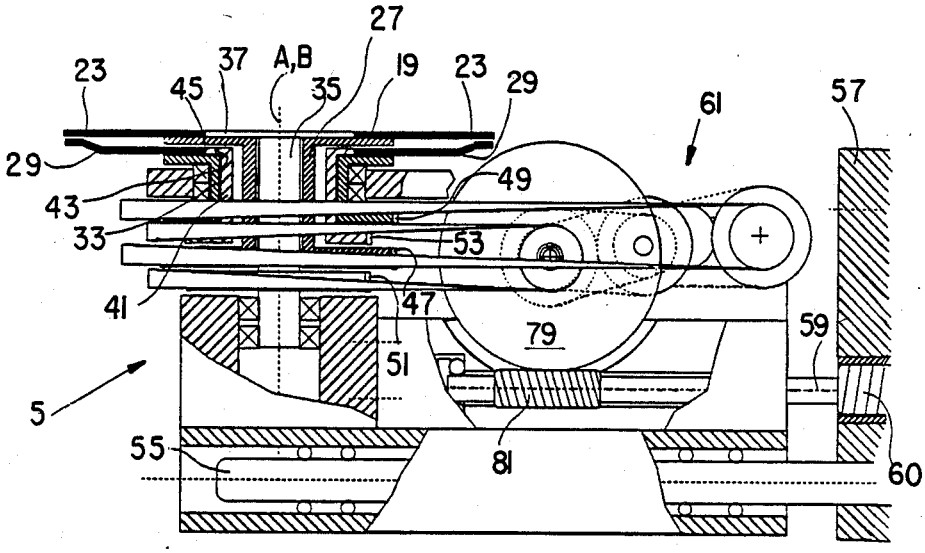
FIG. 2 is an enlarged cross-sectional view of the winding machine including a more detailed illustration of the thread guiding apparatus of the invention.

Mounted upon both of the drive sleeves or sleeve members 27 and 33 as well as the adjustment shafts 35 and 41 are the drive or belt discs 47, 49, 51 and 53, as particularly well seen by inspecting FIG. 2.

It is also to be recognized that the thread guiding apparatus 5 is displaceably mounted by means of a lengthwise or longitudinal guide structure or guide means 55 which is arranged at a support or support member 57 mounted at the machine frame 1. By means of a spindle or spindle member 59 which is mounted in a thread or thread means 60 in the support 57 it is possible to displace the thread guiding or guide apparatus 5 at the longitudinal guide structure or guide means 55. The drive or drive means 16 directly drive the shaft member 63 which coacts with a gear train or gearing arrangement 61 which is seated at the thread guiding apparatus 5. In particular, a belt member 65 leads from the shaft member 63 via the drive pully or disc 47 to a tensioning roll 67 and from that location is guided over the drive disc or pulley 49 back to the shaft member 63. In this way it is possible to drive both of the thread guide wings or vanes 19 and 21 by means of the shaft member 63 so as to rotate in opposite directions, however at the same rotational speed.

Figure 3:
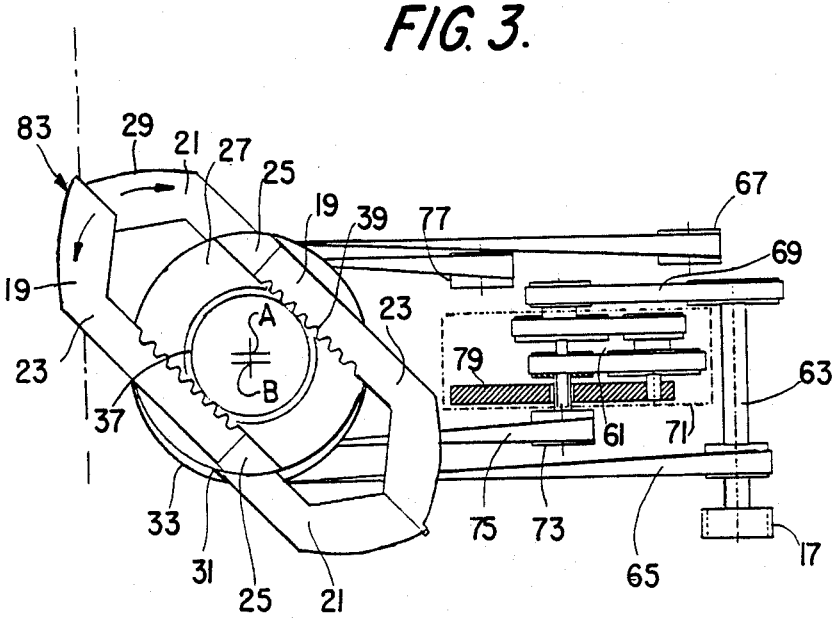
FIG. 3 is a top plan view of the thread guiding apparatus depicted in FIG. 2.

A belt member 69 or the like leads from adjustment or adjusting gearing 71, shown schematically in broken lines in FIG. 3. This adjustment or adjusting gearing 71, the construction of which is not subject matter of the present invention, is provided at its output side with a belt pulley or disc 73 over which travels a belt or belt member 75 initially to the drive pulley or disc 53, from that location via a tensioning roll or roller 77 to the drive pulley or disc 51 and finally back to the belt pulley or disc 73. In this way, both of the gears 37 and 43 are rotated in opposite sense or direction, however, likewise at the same rotational speed. The adjustment or adjusting gearing 71 which, in the illustrated exemplary embodiment is constructed as a planetary gearing system, possesses a worm gear 79 for changing the output rotational speed. This worm gear 79 meshes with a worm 81 located upon the spindle or spindle member 59 and carries the planetary gears. It is also possible to use for the adjustment or adjusting gearing or drive 71 a planetary gear system having a spur gear as the planetary carrier or support, in which case then the spur gear can be externally adjusted by means of a gear rack meshing with such spur gear.

Instead of using the common spindle or spindle member 59 for driving the worm gear 79 or for the inward and outward displacement, as the case may be, of the thread guiding apparatus 5, there also could be employed two mutually independent spindles. The drive of the spindle or spindle member 59 or two independent spindles can be accomplished manually or by means of a conventional stepping motor or, as will be explained more fully hereinafter, by the pivotal arm or arm member 13.

In the description to follow there will be considered the mode of operation of the thread guiding apparatus 5. With appropriate selection of the transmission ratio in the gear train of the adjustment or adjusting gearing 71 and the diameter of the drive pulleys or discs 47, 49, 51 and 53 all of the drive pulleys or discs rotate at constant velocity. Under these preconditions the diameter or lengthwise extent of each of the third guiding wings or vanes 19 and 21 remains constant. The transfer of the thread 83 or the like thus is always accomplished at the same transfer locations.

By rotating the worm gear 79 the gears 37 and 43 can be adjusted relative to the drive sleeves or sleeve members 27 and 33 which carry the thread guide wings or vanes 19 and 21, respectively. This relative motion causes a displacement of the leg members 23 and 29 in the guide slots or grooves 25 and 31, respectively, and thus brings about a change in the diameter or lengthwise extent of both of the thread guide wings or vanes 19 and 21. This change in the diameter or lengthwise extent of both of the thread guide wings or vanes 19 and 21 causes the thread transfer points or locations to be either inwardly shifted, upon shortening the lengthwise extent or diameter of the thread guide wings or vanes 19 and 21, or else to be displaced outwardly upon correspondingly lengthening the diameter or lengthwise extent of such thread guide wings or vanes 19 and 21. This displacement can be accomplished in stepwise fashion or, for instance, as a function of the diameter of the thread wind-up bobbin 11 upon which there is being formed the thread package. If the change is accomplished as a function of the diameter of the wind-up bobbin 11, then the adjustment of the worm gear 79 can be undertaken directly by means of a connection between the bobbin support arm 13 and the spindle 59, which connection can be perfected by not particularly illustrated mechanical connection elements. Of course, the sensing and transmitting of the sensed change of the diameter of the wind-up bobbin 11 also can be achieved with the use of appropriate electronic sensors and can occur by means of a stepping or adjustment motor which is operatively connected with such electronic sensors and which drives the spindle 59.

To ensure that the geometric conditions can be maintained constant during the change of the thread transfer points or locations owing to the adjustment of the length or diameter of the thread guide wings or vanes 19 and 21, the entire thread guiding apparatus 5 must be displaced relative to the support roll 15 in that there is appropriately rotated the threaded spindle 59 within the support or support member 57.

When using a conventional arcuate or curved thread guide plate 85, as such for instance has been disclosed in the aforementioned commonly assigned U.S. Pat. No. 3,823,886, such also must be displaced so that the thread transfer points each always possess an essentially constant spacing from the axis of the support roll or roller 15. The device for the displacement of the curved thread guide plate 85 need not here be further considered since it is not subject matter of the present invention.

According to a preferred exemplary embodiment of the invention, the thread transfer is in fact accomplished without the use of a curved thread guide plate. For this purpose, the ends or end regions of the thread guide wings or vanes 19 and 21 have a special construction as will be described hereinafter with reference to FIGS. 5 to 7.

Figure 5:
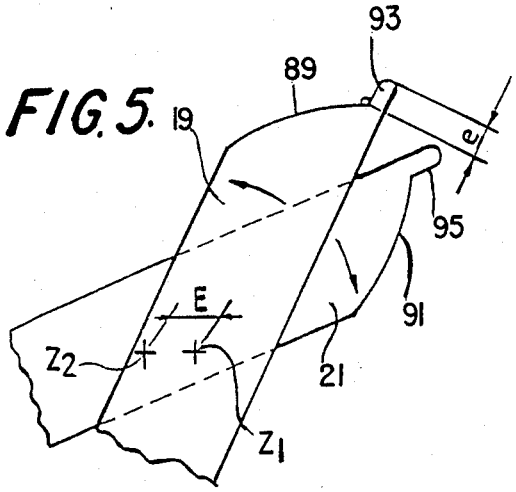
FIGS. 5, 6 and 7 respectively depict different operational positions of the thread guiding wings or vanes during thread transfer.
Figure 6:
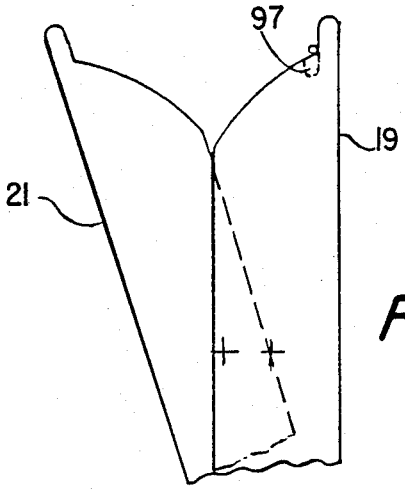
Figure 7:
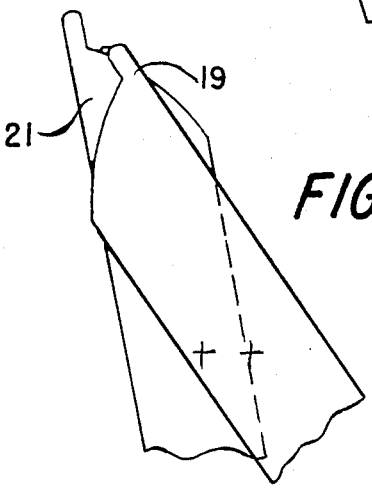

It will be seen from such FIGS. 5 to 7 that at the ends or end regions of each of the thread guide wings or vanes 19 and 21 and specifically the leg members 23 and 29 thereof, there is formed a respective curved or arcuate-shaped contact or run-on edge 89 and 91, respectively, which merges with an associated holding and transport edge 93 and 95, respectively, extending essentially radially with respect to the associated rotation centers or axes Z1 and Z2, respectively. As will be understood by referring to FIG. 5, the length e of the transport edges or edge portions 93 and 95 each correspond to a value which can be computed from the equation:

$$e = \frac{E}{\sqrt{2}}$$

wherein:

E represents the eccentricity between both of the rotation centers or axes Z1 and Z2.

The optimum design of the contact or run-on edges 89 and 91 is based upon the length and width relationship of the thread guiding wings or vanes 19 and 21 and the average length of the thread traversing stroke. It is there further remarked that the thread 83 of the like which travels from the thread guides 9 over the thread guiding wings or vanes 19 and 21 has the tendency of migrating towards the center of the displacement stroke or path owing to the prevailing thread tension. At the beginning of the thread stroke or path, that is to say, with maxium thread deflection, the transversely extending force component is greatest and the danger exists that the thread 83 will move away from the thread guide wings of vanes 19 and 21 and only gradually again be overtaken thereby. Should that happen then there could be formed thread accumulations due to the momentarily prevailing lower thread traversing velocity.

Now in order to be able to always guide in a controlled fashion also thread having good sliding properties, the invention proposes providing thread transfer or transition regions between the respective head contact or run-on edges 89 and 91 and the transport edges or edge portions 93 and 95, respectively, with an associated groove or groove member 97 where there comes to like the thread 83 at the reversal point. Due to this design the thread 83 thus cannot lead or travel ahead of the related thread guide wing 19 and 21 due to the forces acting in axial direction of the wind-up bobbin 11. The depth of each of the grooves 97 and their shape depends upon the yarn number of yarn count and the quality of the thread 83 and is to be appropriately selected in each case.

The contact or run-on edges or edge portions 89 and 91, the transport edges or edge portions 93 and 95 are as well as the grooves 97 are appropriately protected against wear by the application of suitable measures, such as hardening, the insertion of ceramic components and the like.

While there are shown and described present preferred embodiments of the invention, it is to be distinctly understood that the invention is not limited thereto, but may be otherwise variously embodied and practiced within the scope of the following claims. Accordingly,

What we claim is:

1. A thread guiding apparatus for winding up threads into cross-wound bobbins, comprising:

two thread guide wings;

drive means for rotating said two thread guide wings in opposite directions about respective eccentrically arranged axes of rotation;

each of said thread guide wings having a lengthwise extent;

means for altering the lengthwise extent of each said thread guide wings during rotation of said thread guide wings;

each of said two thread guide wings comprising a pair of leg members arranged substantially point-symmetrically with respect to the associated axis of rotation thereof;

guide means for guiding each of said thread guide wings so as to be displaceable in lengthwise direction thereof;

a drive sleeve provided for each thread guide wing arranged substantially concentrically with respect to the axis of rotation of said thread guide wing and carrying the leg members of the associated thread guide wing;

said means for altering the lengthwise extent of said thread guide wings comprising:

internal teeth means provided for each of said thread guide wings;

entrainment means provided for each of said thread guide wings seated upon the drive sleeve of the associated thread guide wing; and said entrainment means of each said thread guide wings meshing internally with the internal teeth means of the associated thread guide wing seated upon the associated drive sleeve carrying the pair of leg members of said associated thread guide wing.

2. The thread guiding apparatus as defined in claim 1, wherein:

each of said entrainment means comprises gear means.

3. The thread guiding apparatus as defined in claim 1, wherein:

each of said entrainment means comprises a substantially equal-armed lever member provided with entrainment bolt means.

4. The thread guiding apparatus as defined in claim 1, wherein:

each of said thread guide wings contains a pair of said leg members;

said guide means for each of said thread guide wings comprises groove means extending eccentrically with respect to said axis of rotation of such thread guide wing;

said pair of leg members of each said thread guide wing being guided for lengthwise displacement in the associated groove means; and each of said pair of leg members of each said thread guide means being provided with said internal teeth means at lateral portions of said pair of leg members.

5. The thread guiding apparatus as defined in claim 1, wherein:

said means for rotating each of said thread guide wings comprises belt means conjointly wrapping about said drive sleeves.

6. The thread guiding apparatus as defined in claim 1, wherein:

said drive means for rotating said thread guide wings comprise:

an adjustment shaft provided for each of said entrainment means of each said thread guide wing;

each said adjustment shaft supporting the associated entrainment means; and said drive means comprising a common belt means trained about said adjustment shafts supporting said entrainment means and driving said entrainment means.

7. The thread guiding apparatus as defined claim 6, wherein:

said drive means is structured for altering the rotational speed of said entrainment means relative to the rotational speed of said thread guide wings in order to adjust the lengthwise extent of each of said thread guide wings.

8. The thread guiding apparatus as defined in claim 7, wherein:

said drive means include:

shaft means for driving said thread guiding apparatus;

belt pulley means for driving said adjustment shafts; and adjustment gearing means incorporated between said shaft means driving said thread guiding apparatus and said belt pulley means for the drive of said adjustment shafts in order to change the rotational speed of said entrainment means.

9. The thread guiding apparatus as defined in claim 8, wherein:

said adjustment gearing means comprises planetary gearing means;

said planetary gearing means comprising a worm gear serving as a planetary support means;

a worm cooperating with said worm gear; and an externally operative spindle means connected with said worm for adjusting said planetary gear means.

10. The thread guiding apparatus as defined in claim 8, wherein:

said adjustment gearing means comprises planetary gearing means having a spur gear as planetary support means; and externally operable gear rack means meshing with said spur gear for adjustment of said spur gear.

11. The thread guiding apparatus as defined in claim 9, further including:

wind-up bobbin means upon which there is wound-up the thread;

pivotal arm means operatively connected with said wind-up bobbin means;

said spindle means being operatively connected with said pivotal arm means; and said spindle means being actuatable by said pivotal arm means as a function of the diameter of the package of thread wound-on said wind-up bobbin.

12. The thread guiding apparatus as defined in claim 9, further including:

a machine frame for supporting said thread guiding apparatus;

longitudinal guide means provided for said thread guiding apparatus;

said spindle means being provided with thread means for the lengthwise displacement of said spindle means in said machine frame; and said spindle means upon rotation thereof displacing said thread guiding apparatus relative to said machine frame upon said longitudinal guide means.

13. The thread guiding apparatus as defined in claim 12, further including:

gear rack means fixedly mounted in said machine frame; and said spindle means upon displacement of said thread guiding apparatus accomplishing a change in rotational speed of said entrainment means relative to said thread guiding wings.

14. The thread guiding apparatus as defined in claim 9, further including:

a wind-up bobbin upon which there is wound the thread;

pivotable arm means for supporting said wind-up bobbin;

said thread guiding apparatus being operatively connected with said pivotable arm means; and said thread guiding apparatus being actuatable by said pivotable arm means in dependency upon the diameter of a package of thread wound upon said wind-up bobbin.

15. The thread guiding apparatus as defined in claim 1, wherein:

each of said thread guide wings is provided with a curved contact edge portion for the thread; and a thread transport edge merging with said curved thread contact edge portion provided for each thread guide wing.

16. The thread guiding apparatus as defined in claim 15, wherein:

each thread guide wing includes a thread receiving groove at a transfer zone between said curved contact edge portion and said thread transport edge of each thread guide wing.

* * * * *